United States Patent [19]

Breslow

[11] 3,989,243

[45] Nov. 2, 1976

[54] REACTION GAME APPARATUS

[75] Inventor: Jeffrey D. Breslow, Highland Park, Ill.

[73] Assignee: Marvin Glass & Associates, Chicago, Ill.

[22] Filed: Oct. 20, 1975

[21] Appl. No.: 623,771

[52] U.S. Cl. ..... 273/1 R; 273/135 E

[51] Int. Cl.[2] ..... A63F 9/00

[58] Field of Search ..... 273/1 R, 127 D, 135 R, 273/135 AA, 135 E, 136 F

[56] References Cited

UNITED STATES PATENTS

| | | | |
|---|---|---|---|
| 1,466,534 | 8/1923 | Kuen | 273/135 E |
| 1,489,028 | 4/1924 | Fishel | 273/135 E |
| 1,650,029 | 11/1927 | Morton | 273/127 D |
| 3,204,956 | 9/1965 | Ames | 273/1 R |
| 3,339,921 | 9/1967 | Glass et al. | 273/1 R |
| 3,747,934 | 7/1973 | Barrett | 273/135 E |
| 3,897,952 | 8/1975 | Breslow | 273/127 D |

FOREIGN PATENTS OR APPLICATIONS

| | | | |
|---|---|---|---|
| 304,440 | 1/1929 | United Kingdom | 273/135 E |

*Primary Examiner*—Richard C. Pinkham
*Assistant Examiner*—Harry G. Strappello
*Attorney, Agent, or Firm*—Coffee & Sweeney

[57] ABSTRACT

A game apparatus in which dice are employed as a chance numerical selection device. The game apparatus includes an elongated base having generally parallel elongated sides. A plurality of flippers are pivotally mounted along the sides of the base for movement generally perpendicular thereto from outer positions to positions centrally between the sides where one flipper will be disposed on top of another. Identical numbers are disposed on both sides of opposite flippers whereby the uppermost flipper, when both flippers are in the central position, will cover the number on the lowermost flipper. A dice receiving receptacle is disposed at one end of the base into which dice may be thrown by the players of the game. The flippers are arranged so that the numbers are randomly disposed along the base and the flippers are removable for changing the random arrangement. Scoring means is provided along the base for opposing players of the game beneath the pivotal mounting of the flippers.

19 Claims, 3 Drawing Figures

REACTION GAME APPARATUS

BACKGROUND AND SUMMARY OF THE INVENTION

This invention relates to a game apparatus designed primarily for amusement purposes but which has a wide range of utility involving mental arithmetic and a nicety of judgment in playing the game of the apparatus and for certain educational purposes.

The game apparatus is designed primarily for use with a pair of dice for numerical chance selection. The apparatus is a self-contained device having a dice receiving receptacle into which dice may be thrown by players of the game. Scoring means for opposing players is provided directly on the base structure of the apparatus.

More particularly, in the exemplary embodiment of the invention, an elongated channel shaped base structure is provided with a lower floor portion and generally parallel elongated upright flanges defining the sides of the channel. A plurality of flippers are pivotally mounted on a rod which extends longitudinally of the base generally at the top of the sides thereof. Thus, the flippers are pivotally movable generally perpendicular to the base from positions outside of the sides thereof to positions on top of the floor of the base generally centrally between the sides. Each of the flippers along one side of the base has numerical indicating means on each side thereof identical to the numerical indicating means on the opposite flipper on the other side of the base. The flippers are of sufficient length so as to cover the numerical indicating means of an opposing flipper when both flippers are disposed one on top of the other in the central position on the floor of the base. A semicircular dice receiving receptacle is disposed at one end of the base into which dice may be thrown by players of the game. Preferably, the flippers are arranged along the sides of the base so that the numerical indicating means thereon is arranged randomly along the sides of the base, rather than seriatim. Furthermore, the mounting rods for the flippers are removable from the base so that the random arrangement of the flippers can be selectively changed. In the exemplary embodiment, the flippers along each side of the base are 12 in number and have numerical indicating means thereon from the number 1 to the number 12 to accommodate numerical combinations of at least a pair of dice.

Another feature of the invention is the provision of scoring means for opposing players of the game on the floor of the base adjacent to and along the inside of the upstanding sides and beneath the inclined flippers. The scoring means as shown herein includes a plurality of holes along the side flanges and a pair of pegs, one for each player, positionable in the holes beneath the inclined flippers. The scoring means also includes a series of numbers on the floor of the base generally parallel to and between the opposite rows of holes for the pegs.

Other objects, features and advantages of the invention will be apparent from the following detailed description taken in connection with the accompanying drawings.

DETAILED DESCRIPTION OF THE INVENTION

Figures 1, 2, 3:
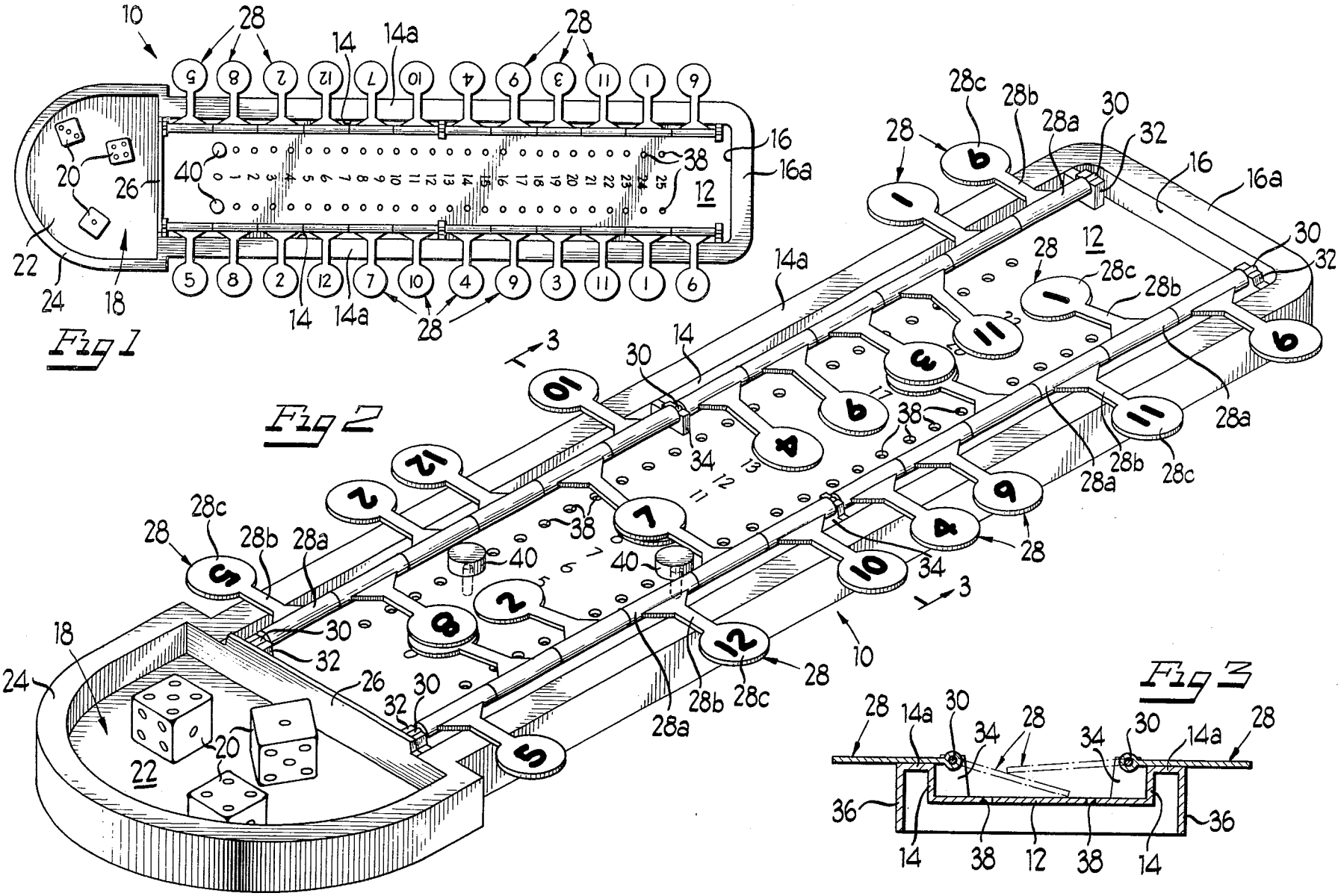
FIG. 1 is a top plan view of the game apparatus of the present invention utilizing three dice and showing all of the flippers in their outer positions.
FIG. 2 is a perspective view, on an enlarged scale, of the game apparatus of the present invention showing the flippers and scoring means in various positions as would be encountered during play of the game.
FIG. 3 is a vertical section taken generally along the line 3—3 of FIG. 2 with the flippers shown in full lines in their outer positions and in phantom in their inner positions.

Referring to the drawings in greater detail, the game apparatus of the present invention, generally designated 10, includes a base structure having a floor portion 12, a pair of parallel upstanding sides 14 in the form of upright flanges, and an end wall 16 formed integral with the floor 12 and side walls 14. It should be noted that the side walls 14 (as well as the end walls 16) have flat tops **14*a* and 16*a***, respectively.

Opposite the end wall 16, the base has a generally semi-circular receptacle, generally designated 18, into which dice 20 may be thrown by the players of the game. The receptacle 18 includes its own floor portion 22 and a generally semi-circular upstanding side wall 24 bounding the floor 22 to retain the dice therein. An upright backup plate 26 is disposed at one end of the main floor 12 of the base to prevent the dice from moving onto the floor 12 and interfere with the flippers, described hereinafter.

The game apparatus of the present invention includes a plurality of flippers, generally designated 28, which are pivotally mounted along the top of the side walls 14 of the base adjacent the inside thereof. More particularly, each flipper has a tubular portion **28*a*, an intermediate arm portion 28*b* connected to the tubular portion, and a head portion 28*c* on the end of the arm portion 28*b* opposite the tubular portion 28*a*. As seen in FIGS. 1 and 2, the flippers are mounted with their tubular portions 28*a* in alignment and through which rods 30 (FIG. 3) pass to pivotally mount the flippers for individual movement. The rods 30 each are snap fit into end supporting members 32 and central supporting members 34 which have recesses in the top thereof slightly less in diameter at their opening than the rods so as to provide a snap fit. Thus, as can be seen in FIG. 3, the flippers 28 are movable from outer positions as shown in full lines where the flippers rest on the top 14*a* of the adjacent side wall 14 of the base, to inner positions shown in phantom where the head portion 28*c*** of one of the flippers covers the head portion of an opposite flipper.

Further, as seen in FIG. 3, the side wall 14 and top 14a of the base continue on and are integral with outer support walls 36 surrounding the base.

Each head portion **28*c* of each flipper 28 has numerical indicating means on each side thereof. In the exemplary embodiment of the invention, the numerical indicating means comprises the numbers 1 through 12 on the flippers on each side of the base. As seen in the drawings, the numbers of opposite flippers are identical. Also, in the preferred embodiment, the flippers are arranged so that the numbers on each side are random rather than in series from 1 to 12. With the numbers disposed on the heads, as can be seen in FIG. 2**, when opposing flippers are in their inner positions, the number on the lowermost flipper will be covered by the numbered head of the uppermost flipper.

With the rods 30 snap fit into the support members 32 and 34, it is possible to easily change the random orientation of the flippers by simply removing the rods from the support members and changing the arrangement of the flippers. In fact, if a series of numbers is desirable, such is easily accomplished.

Scoring means is provided directly on top of the floor portion 12 of the base. More particularly, a row of holes 38 are provided in the floor 12 inwardly of the sides of the base and extending longitudinally therealong. Each player has a peg 40 which is positionable in and movable along the rows of holes. Numbers in series from 1 to 25 (from left to right in the drawings) are printed on the floor 12 between and in alignment with the holes 38. The use of this scoring means will be described below in conjunction with the play of the game.

In playing the game of the present invention, at least two dice preferably are used so as to provide any combination of numbers up to 12 for the 12 flippers shown. However, more than two dice can be utilized, as with the three dice shown in the drawings. The game is started with all of the flippers in their outer positions resting on the top 14a of the base, as seen in FIG. 1. The pegs 40 are in their leftmost 0 position, also as seen in FIG. 1. A player (or even a non-participant) is selectetd to throw the dice 20 into the receptacle 18. With reference to FIG. 1, it can be seen that six different combinations of numbers are provided by the number representations of the dice. Of course, each individual dice is utilized to represent the number 1 (the lowermost die), the number 3 (the lefthand upper die) and the number 4 (the upper righthand die). In addition, the 1 and 4 dice can be combined to arrive at the number 5 and the uppermost dice can be combined to arrive at the number 7. Finally, all three dice can be combined to arrive at the number 8. Obviously, there would be no combination between the lowermost die and the upper lefthand die since the number 4 is represented by the singular upper righthand die. The object of the game is for the opposing players on opposite sides of the game apparatus to be the first to recognize the numbers on the individual dice as well as the various combinations between the dice and be the first to flip his respective flippers corresponding to those numbers and combinations into the innermost position as shown by the 8 flippers in FIG. 2. Since the heads 28c of the flippers are capable of covering the heads of opposing flippers, the player who first moves his flipper to the inner position is readily apparent. In order to score the game, the number of flippers in any one turn which a single player has been the first to move toward the inner position to correspond to the number combinations are added for each player and his peg is moved the corresponding number of holes along his side of the floor 12 of the base. Of course, provision can be made for a player who happens to flip a wrong number flipper into the center of the base and those flippers could be subtracted from his number of successful flippers.

With reference to FIG. 2, it is apparent that the numbers and combinations of numbers available by the roll of the dice shown are 1, 4, 5, 6, 9 and 10. It should be pointed out, however, that these combinations of numbers are not represented by the particular orientation of the flippers shown in FIG. 2.

The foregoing detailed description has been given for clearness of understanding only and no unnecessary limitations should be understood therefrom as some modifications will be obvious to those skilled in the art.

I claim:

1. A game apparatus in which dice are employed as a chance numerical selection device, the game apparatus comprising:

an elongated base having generally parallel elongated sides;

a plurality of flippers pivotally mounted along said sides for movement generally perpendicular thereto from outer positions to positions on the base generally centrally between said sides, each of said flippers along one side of the base having numerical indicating means on each side thereof identical to the numerical indicating means on the opposite flipper on the other side of the base, the flippers being of sufficient length so as to cover the numerical indicating means of an opposing flipper when both flippers are disposed one on top of the other in said central position on the base; and a dice receiving receptacle at one end of the base into which dice may be thrown by players of the game.

2. The game apparatus of claim 1 wherein the flippers are arranged along said sides of the base so that the numerical indicating means thereon is arranged randomly along the sides of the base rather than seriatim.

3. The game apparatus of claim 2 including means for adjustably mounting said flippers along the sides of the base so as to provide means for changing the random arrangement thereof.

4. The game apparatus of claim 3 wherein said flippers are pivotally mounted on a rod extending longitudinally along each of the sides of the base, said rods being removably mounted on the base.

5. The game apparatus of claim 2 wherein the flippers along each side of the base are twelve in number and have numerical indicating means thereon from the number 1 to the number 12 to accommodate numerical combinations of at least a pair of dice.

6. The game apparatus of claim 1 wherein said base is channel shaped with the sides thereof defined by upstanding longitudinal flanges adjacent the top of which said flippers are pivotally mounted and said central position of the flippers is defined by the lower floor of the channel with the flippers inclined downwardly thereto.

7. The game apparatus of claim 6 including scoring means for opposing players of the game on said floor adjacent to and along the inside of said upstanding flanges beneath the inclined flippers.

8. The game apparatus of claim 7 wherein said scoring means includes a plurality of holes along the inside of the side flanges and a pair of pegs, one for each player, positionable in the holes beneath the inclined flippers.

9. The game apparatus of claim 8 wherein said scoring means includes seriatim numerical indicating means longitudinally along said floor between said holes.

10. A game apparatus in which are dice are employed as a chance numerical selection device, the game apparatus comprising:

an elongated channel shaped base having a floor portion and generally parallel elongated upright flanges defining the sides of the base;

a plurality of flippers pivotally mounted adjacent the top of said sides for movement generally perpendicular thereto from outer positions to positions inclined downwardly to the floor of said base generally centrally between said sides, each of said flippers along one side of the base having numerical indicating means on each side thereof identical to the numerical indicating means on the opposite flippers on the other side of the base, the flippers being of sufficient length so as to cover the numerical indicating means of an opposing flipper when both flippers are disposed one on top of the other in said central inclined position on the floor of the base; and scoring means for opposing players of the game on said floor adjacent to and along the inside of said upstanding flanges which define the sides of the base and beneath the inclined flippers.

11. The game apparatus of claim 10 wherein said scoring means includes a plurality of holes along the side flanges and a pair of pegs, one for each player, positionable in the holes beneath the inclined flippers.

12. The game apparatus of claim 11 wherein said scoring means includes seriatim numerical indicating means longitudinally along said floor between said holes.

13. The game apparatus of claim 10 wherein the flippers are arranged along said sides of the base so that the numerical indicating means thereon is arranged randomly along the sides of the base rather than seriatim.

14. The game apparatus of claim 13 including means for adjustably mounting said flippers along the sides of the base so as to provide means for changing the random arrangement thereof.

15. The game apparatus of claim 14 wherein said flippers are pivotally mounted on a rod extending longitudinally along each of the sides of the base, said rods being removably mounted on the base.

16. A game apparatus in which dice are employed as a chance numerical selection device, the game apparatus comprising:

an elongated base having generally parallel elongated sides; and a plurality of flippers pivotally mounted along said sides for movement generally perpendicular thereto from outer positions to positions on the base generally centrally between said sides, each of said flippers along one side of the base having numerical indicating means on each side thereof identical to the numerical indicating means on the opposite flipper on the other side of the base, the flippers being of sufficient length so as to cover the numerical indicating means of an opposing flipper when both flippers are disposed one on top of the other in said central position on the base.

17. The game apparatus of claim 16 wherein the flippers are arranged along said sides of the base so that the numerical indicating means thereon is arranged randomly along the sides of the base rather than seriatim.

18. The game apparatus of claim 17 including means for adjustably mounting said flippers along the sides of the base so as to provide means for changing the random arrangement thereof.

19. The game apparatus of claim 18 wherein said flippers are pivotally mounted on a rod extending longitudinally along each of the sides of the base, said rods being removably mounted on the base.

* * * * *